US011105118B2

(12) United States Patent
Morse et al.

(10) Patent No.: US 11,105,118 B2
(45) Date of Patent: Aug. 31, 2021

(54) DOOR HANDLE WITH ADJUSTABLE PULL MOUNTING MECHANISM

(71) Applicant: Spectrum Brands, Inc., Middleton, WI (US)

(72) Inventors: Thomas P. Morse, Foothill Ranch, CA (US); Wu De, Fujian (CN); Jack Zhang, Fujian (CN); Jeanette V. Bui, Lake Forest, CA (US)

(73) Assignee: Spectrum Brands, Inc., Middleton, WI (US)

( * ) Notice: Subject to any disclaimer, the term of this patent is extended or adjusted under 35 U.S.C. 154(b) by 219 days.

(21) Appl. No.: 16/086,560

(22) PCT Filed: Mar. 21, 2017

(86) PCT No.: PCT/US2017/023320
§ 371 (c)(1),
(2) Date: Sep. 19, 2018

(87) PCT Pub. No.: WO2017/165355
PCT Pub. Date: Sep. 28, 2017

(65) Prior Publication Data
US 2019/0048616 A1 Feb. 14, 2019

Related U.S. Application Data

(60) Provisional application No. 62/383,768, filed on Sep. 6, 2016, provisional application No. 62/311,545, filed on Mar. 22, 2016.

(51) Int. Cl.
*E05B 1/00* (2006.01)
*E05B 63/00* (2006.01)
(Continued)

(52) U.S. Cl.
CPC ..... *E05B 1/0053* (2013.01); *E05B 1/0015* (2013.01); *E05B 3/02* (2013.01);
(Continued)

(58) Field of Classification Search
CPC ... Y10T 292/57; Y10T 292/82; Y10T 292/91; Y10T 292/85; Y10T 70/5832;
(Continued)

(56) References Cited

U.S. PATENT DOCUMENTS 2,001,666 A * 5/1935 Keil ..... E05B 15/02 16/444
2,266,106 A * 12/1941 Voight ..... E05B 55/00 70/153
(Continued)

FOREIGN PATENT DOCUMENTS

KR 950010294 B1 9/1995
WO 2016/033804 A1 3/2016

OTHER PUBLICATIONS

International Search Report and Written Opinion for PCT/US2017/023320 (dated Jun. 26, 2017).

*Primary Examiner* — Mark A Williams
(74) *Attorney, Agent, or Firm* — Merchant & Gould P.C.

(57) ABSTRACT

The present disclosure relates to a door handle having a grip with a first end and a second end. The door handle further includes an upper mounting plate coupled to the first end of the grip and a lower mounting plate coupled to the second end of the grip. A mounting post is coupled to the lower mounting plate and is configured to move relative to the lower mounting plate. Means for adjusting the position of the mounting post with respect to the lower mounting plate facilitate movement of the mounting post along at least two axes. The means for adjusting the mounting post may further comprise a rotating arm that is pivotally connected to the
(Continued)

lower mounting plate and to which the mounting post is attached.

19 Claims, 7 Drawing Sheets

(51) Int. Cl.
*E05B 3/02* (2006.01)
*E05B 85/12* (2014.01)
*E05B 85/14* (2014.01)
*E05B 7/00* (2006.01)

(52) U.S. Cl.
CPC ..... *E05B 63/0056* (2013.01); *E05B 85/12* (2013.01); *E05B 85/14* (2013.01); *E05B 7/00* (2013.01)

(58) Field of Classification Search
CPC ... Y10T 292/06; Y10T 16/458; Y10T 16/459; Y10T 16/498; Y10T 16/502; Y10T 16/506; E05B 13/005; E05B 63/006; E05B 13/101; E05B 15/0053; E05B 1/00; E05B 2047/0091; E05B 1/0053; E05B 1/0015; E05B 3/02; E05B 63/0056; E05B 5/12; E05B 85/14; E05B 7/00; E05C 1/14; E05C 3/162; Y10S 292/27; Y10S 292/53; Y10S 292/64; Y10S 292/60
See application file for complete search history.

(56) References Cited

U.S. PATENT DOCUMENTS 2,300,905 A * 11/1942 Brantingson ..... E05C 1/12 292/165
4,378,071 A * 3/1983 Yakimicki ..... A47H 99/00 211/105.4
5,084,940 A * 2/1992 Loffler ..... E05B 1/0015 16/412
5,797,164 A * 8/1998 Donaghy ..... A47B 95/02 16/412
7,281,301 B2 10/2007 Huang et al.
7,290,808 B2 11/2007 Furlong
2004/0183316 A1* 9/2004 Walls ..... E05B 63/04 292/336.3
2005/0156439 A1* 7/2005 Furlong ..... E05B 63/0056 292/336.3
2006/0162127 A1* 7/2006 Huang ..... E05B 1/0015 16/412
2006/0200948 A1* 9/2006 Steurer ..... E05B 1/0015 16/412
2008/0034553 A1* 2/2008 Wing ..... E05B 1/0015 16/412
2011/0314876 A1* 12/2011 Fang ..... E05B 65/1086 70/91
2014/0033773 A1* 2/2014 Myers ..... E05B 9/082 70/129

* cited by examiner

DOOR HANDLE WITH ADJUSTABLE PULL MOUNTING MECHANISM

CROSS REFERENCE TO RELATED APPLICATIONS

This application is a National Stage Application of PCT/US2017/023311, filed Mar. 21, 2017, which claims the benefit of U.S. Provisional Application No. 62/311,545, filed Mar. 22, 2016, and U.S. Provisional Application No. 62/383,768, filed Sep. 6, 2016, which applications are incorporated herein by reference. To the extent appropriate, a claim of priority is made to each of the above disclosed applications.

TECHNICAL FIELD

This disclosure relates general to door handles; in particular, this disclosure relates to a door handle that allows adjustment of a mounting post during installation.

BACKGROUND

Handlesets are well known devices for opening and closing doors. Typically, a handleset includes a grip with one end connected to an upper mounting plate that is mounted to a bore through the door. A thumb piece extends through the upper mounting plate to actuate the latch assembly for opening the door. The other end of the grip is connected to a lower mounting plate, which is attached to the door with a mounting post mounted through a lower hole in the door.

One challenge posed during installation of a handleset is aligning the mounting post with the lower hole in the door. When installing a replacement handleset, the mounting post might not align with the existing lower hole in the door. This issue often leads to customers returning handlesets. Likewise, it can be problematic for a customer to drill the lower hole in the proper location so it aligns with the mounting post. Others have attempted to provide some level of adjustment in the mounting post, such as described in U.S. Pat. Nos. 7,290,808 and 7,281,301. However, these designs offer only limited flexibility in adjusting the mounting post.

SUMMARY

According to the present disclosure; assemblies, components and methodologies are provided for mounting a door handle to a door that allows for adjustment of a mounting post of a lower mounting plate to permit alignment with a hole in the door. In illustrative embodiments, a grip of a door handle includes a lower mounting plate and a mounting post that is coupled to the lower mounting plate to permit movement of the mounting post relative to the lower mounting plate. The mounting post may include means for connecting the lower mounting plate to the door, such as an aperture to receive a screw or other fastener. A means for adjusting the position of the mounting post with respect to the lower mounting plate are envisioned herein. The means for adjusting the mounting post may permit movement of the mounting post in an up-and-down direction and in a side-to-side direction within a recessed area of the lower mounting plate. The means for adjusting the mounting post may further comprise a rotating arm that is pivotally connected to the lower mounting plate and to which the mounting post is attached.

In some embodiments, a lower mounting plate may comprise a pivotable arm that pivots about an axis of rotation defined by the connection point between the pivotable arm and the lower mounting plate. A mounting post may be slidably connected to the pivotable arm to permit (i) rotation of the mounting plate with the pivotable arm about the axis of rotation and (ii) movement of the mounting plate along the pivotable arm in a direction toward or away from the axis of rotation. The pivotable arm may further comprise a slot to receive the mounting post, and the mounting post may further include a portion that engages with the slot of the pivotable arm to prevent rotation of the mounting post relative to the pivotable arm. The lower mounting plate may further comprise a retaining plate that adds structural rigidity to the lower mounting plate. The retaining plate may be configured to prevent interaction of the mounting post with the retaining plate upon movement of the mounting post, or it may be configured to at least partially restrict movement of the mounting post in relation to the lower mounting plate.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description makes reference to the accompanying figures in which.

DETAILED DESCRIPTION OF THE DRAWINGS

Figure 1:
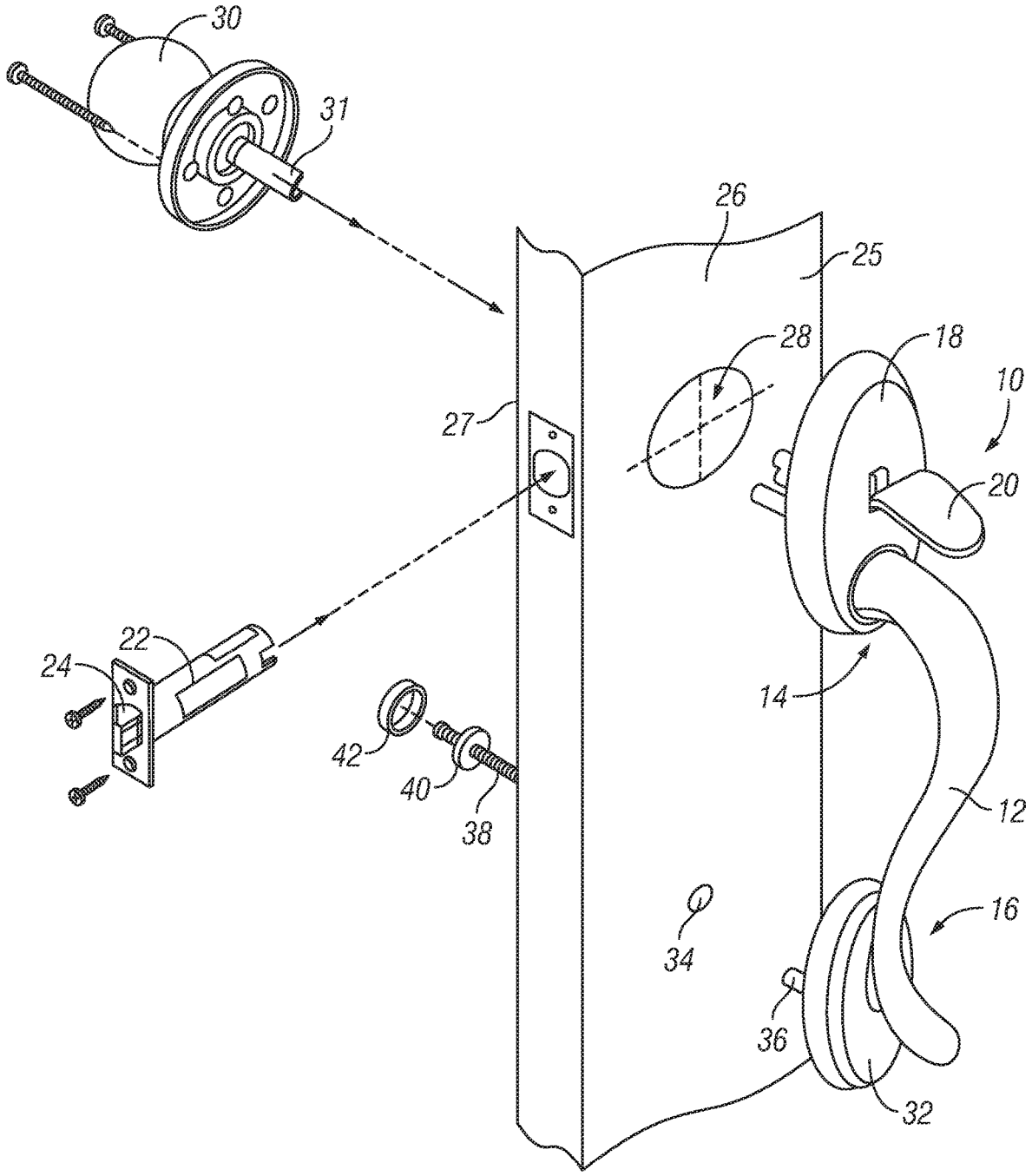
FIG. 1 is an exploded view of an example handleset according to an embodiment of this disclosure.

The figures and descriptions provided herein may have been simplified to illustrate aspects that are relevant for a clear understanding of the herein described devices, systems, and methods, while eliminating, for the purpose of clarity, other aspects that may be found in typical devices, systems, and methods. Those of ordinary skill may recognize that other elements and/or operations may be desirable and/or necessary to implement the devices, systems, and methods described herein. Because such elements and operations are well known in the art, and because they do not facilitate a better understanding of the present disclosure, a discussion of such elements and operations may not be provided herein. However, the present disclosure is deemed to inherently include all such elements, variations, and modifications to the described aspects that would be known to those of ordinary skill in the art.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. Additionally, it should be appreciated that items included in a list in the form of "at least one A, B, and C" can mean (A); (B); (C); (A and B); (A and C); (B and C); or (A, B, and C). Similarly, items listed in the form of "at least one of A, B, or C" can mean (A); (B); (C); (A and B); (A and C); (B and C); or (A, B, and C).

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, may not be included or may be combined with other features.

FIG. 1 shows an example handleset 10, which will also be called a door handle herein. The handleset 10 is shown for purposes of example, but could be any style, shape or size. As shown, the handleset 10 includes a grip 12 with a first end 14 and a second end 16.

The first end 14 of the grip 12 is connected with a first mounting plate 18. As shown, a thumb piece 20 extends through the first mounting plate 18 to engage a latch assembly 22 for retracting a bolt 24 to open a door 26, as is understood in the industry. Typically, the first mounting plate 18 would be mounted to or adjacent to a bore 28 in the door 26. In the example shown in FIG. 1, a door knob 30 would also be mounted to or adjacent to the bore 28 in the door 26. The door knob 30 may include a torque blade 31 configured to rotate with the door knob 30 and also configured to engage with the latch assembly 22 for retracting the bolt 24 to open the door 26, as is understood in the industry. As shown, the handleset 10 would be mounted on an exterior side 25 of the door 26 and the door knob 30 would be mounted on an interior side 27 of the door 26.

The second end 16 of the grip 12 is connected with a second mounting plate 32. The second mounting plate 32 is mounted in or adjacent to a lower hole 34 in the door 26 on the exterior side 25 of the door 26. A fastener on the interior side 27 of the door 26 extends through the door 26 and attaches to a mounting post 36 (FIG. 2) extending from the second mounting plate 32. In the example shown, the fastener includes a screw 38 that extends from the interior side 27 of the door 26 through the lower hole 34 and attaches with the second mounting plate 32. As shown, a washer 40 could be provided with the screw 38, and a cap 42 could be used to cover the head of the screw 38. The second mounting plate 32 is illustratively coplanar with the first mounting plate 18.

Figure 2:
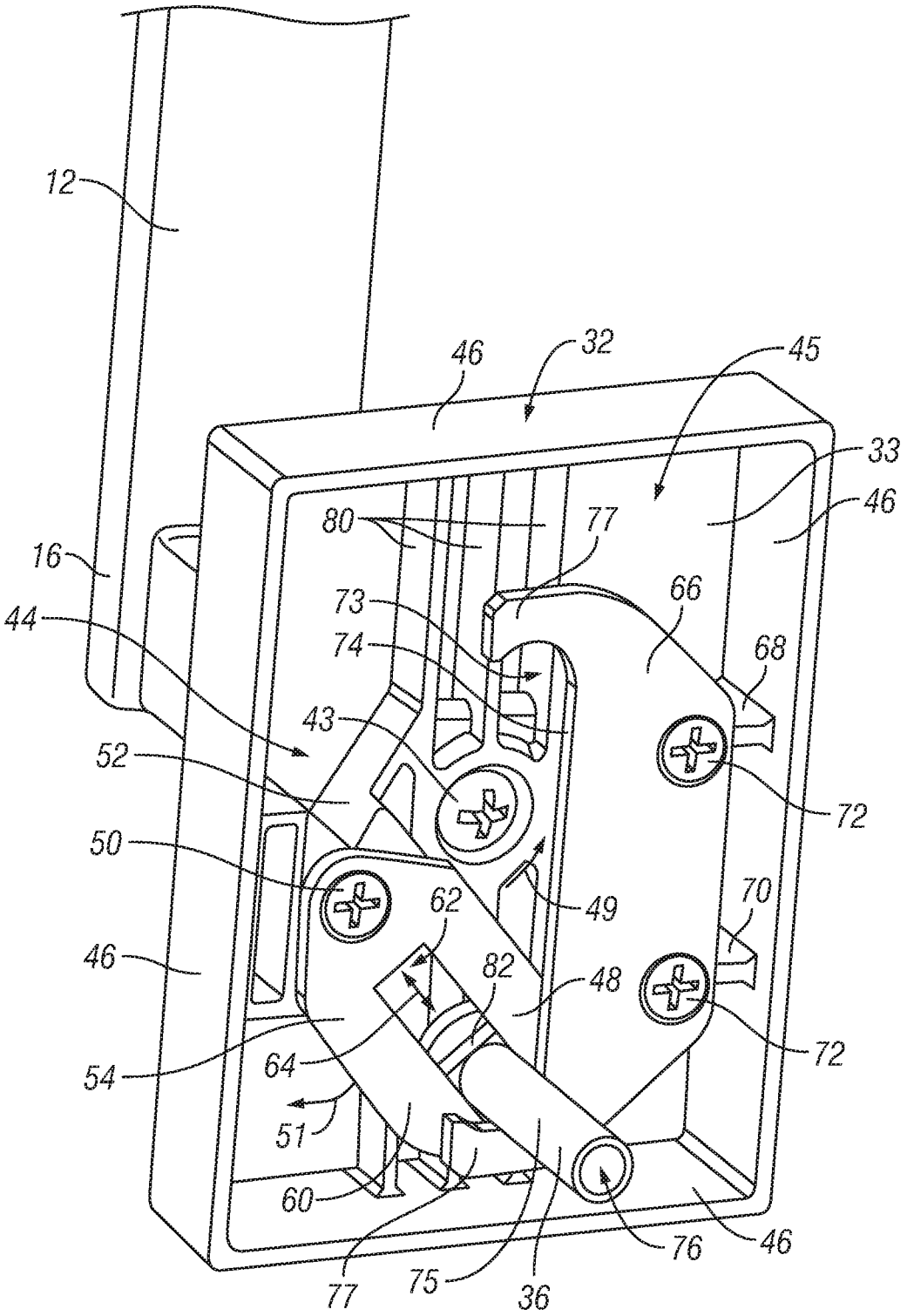
FIG. 2 is a rear view of an example lower mounting plate with an adjustable mounting post according to an embodiment of this disclosure.

FIG. 2 shows the rear portion of the second mounting plate 32 to reveal the mounting post 36 extending from a rear side 33 of the second mounting plate 32 that abuts against the exterior side 25 of the door 26. FIG. 2 further illustrates a mounting post adjustment assembly 44 extending from the rear side 33. As shown, the second mounting plate 32 is attached to the second end 16 of the grip 12 using a fastener 43. In the embodiment shown, the second mounting plate 32 includes a recessed portion 45 defined by a side wall 46 of the second mounting plate 32 and the rear side 33. Although a rectangular side wall 46 is shown for purposes of example, the side wall 46 could be any shape or size as desired for the aesthetic design of the handleset 10. As shown, the mounting post 36 and the mounting post adjustment assembly 44 are mounted in the recessed portion 45 of the second mounting plate 32.

In the embodiment shown, the mounting post adjustment assembly 44 includes a rotating arm 48 pivotally connected to the second mounting plate 32 via a fastener 50. As shown, the rotating arm 48 can rotate in a first direction 49 or a second direction 51 about the fastener 50, which provides freedom of movement for mounting post 36 within the recessed portion 45, as described herein. In an illustrative embodiment, the mounting post 36 may experience up to approximately 1.86 inches of vertical movement (up and down) and/or up to approximately 0.78 inches of horizontal (side-to-side) movement, although other measurements are also envisioned herein. In the example shown, there is a raised area 52 extending away from the rear side 33 in the recessed portion 45 to which the rotating arm 48 is connected.

Figure 3:
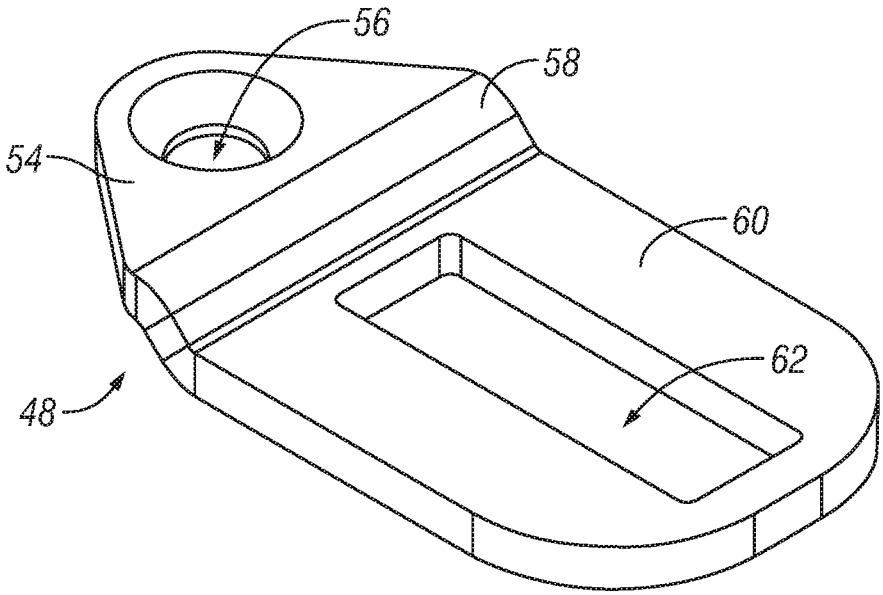
FIG. 3 is a perspective view of an example rotating arm according to an embodiment of this disclosure.
Figure 4:
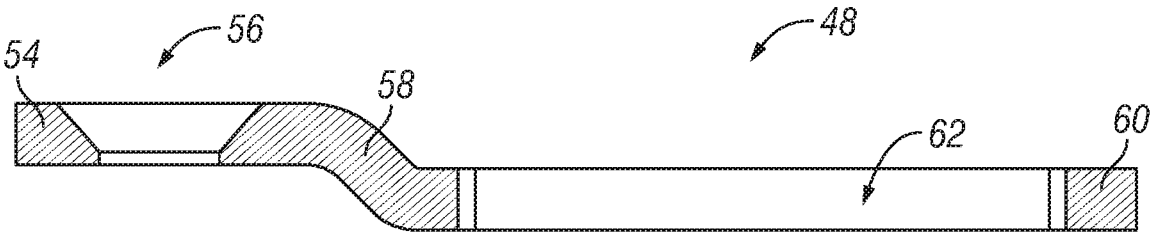
FIG. 4 is a side cross-sectional view of the example rotating arm shown in FIG. 3.
Figure 5:
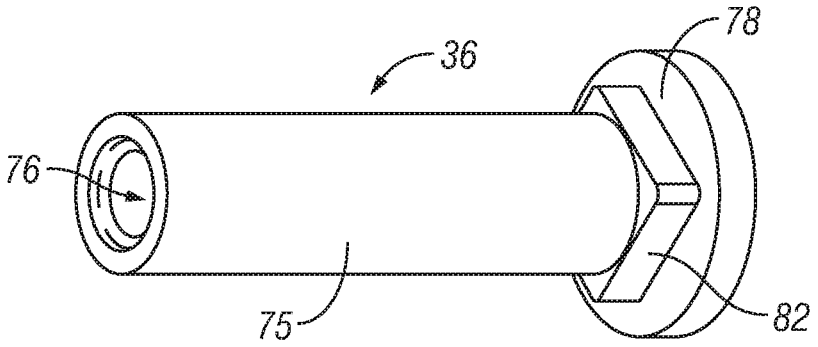
FIG. 5 is a perspective view of an example mounting post according to an embodiment of this disclosure.
Figure 6:
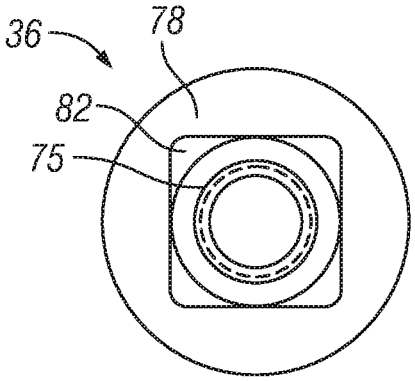
FIG. 6 is a front view of the example mounting post shown in FIG. 5.
Figure 7:
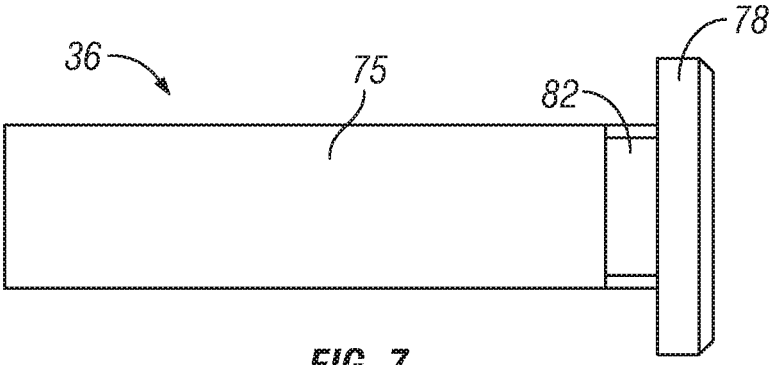
FIG. 7 is a side view of the example mounting post shown in FIG. 5.

Referring also to FIGS. 3 and 4, there is shown an embodiment of the rotating arm 48 with a planar mounting portion 54 with a hole 56 to receive the fastener 50. As shown, a curved portion 58 extends from the mounting portion 54 to a planar mounting post carrier 60. In this embodiment, the mounting portion 54 extends above the mounting post carrier 60 due to the curved portion 58. As shown, the mounting post carrier 60 defines a slot 62 dimensioned to receive the mounting post 36 and permit sliding of the mounting post 36 therethrough. Specifically, the mounting post 36 is slidably connected to the mounting post carrier 60 via the slot 62. This connection allows the mounting post 36 to move within slot 62 along an axis represented by arrow 64 in FIG. 2, which allows further freedom of movement for the mounting post 36. As understood from the figures, the axis 64 will move when the rotating arm 48 rotates about the fastener 50.

As shown, the mounting post adjustment assembly 44 includes a bracket 66 connected to the second mounting plate 32 to increase the strength and rigidity. As shown, the recessed portion 45 includes a first rib 68 and a second rib 70 on which the bracket 66 is connected using fasteners 72. This suspends the bracket 66 above the recessed portion 45 and allows the mounting post carrier 60 to extend and move between the bracket 66 and the rear side 33 of the second mounting plate 32. In various embodiments, the bracket 66 includes a groove or opening 73 at least partially defined by a guide surface 74 of the bracket 66. The groove 73, in illustrative embodiments, may be sized and positioned to not obstruct movement of the mounting post 36, so that movement of the mounting post 36 is limited only by the rotating arm 48. Alternatively, the guide surface 74 may be configured to limit movement of the mounting post 36 as it rotates with the rotating arm 48, thereby acting as a guide for the location of the mounting post 36. In certain embodiments, the mounting post 36 may be constrained for movement only within the groove 73 of the bracket 66. For instance, the groove 73 may limit the side-to-side movement of the mounting post 36 by providing a surface upon which the shank 75 abuts against during movement. There may also be one or more stop flanges 77 of the bracket 66 that limit the up-and-down movement of the mounting post 36. However, the bracket 66 may be configured without the groove 73, guide surface 74, or stop flanges 77 such that the bracket does not restrict or limit movement of the mounting post 36.

Referring now to FIGS. 2 and 5-7, the mounting post 36 includes a shank 75 with an opening 76, which could be a threaded opening, to receive the screw 38. The shank 75 extends from a head portion 78 that slides on ribs 80 extending from the recessed portion 45 as the mounting post 36 is adjusted. In illustrative embodiments, the head portion 78 engages or seats with a flat surface of the ribs 80 to be retained in the ribs 80. In various embodiments, the parameter(s) of the ribs 80 permit up-and-down or side-to-side movement of the mounting post 36. In various embodiments, the ribs 80 may be configured as tracks that restrict or block side-to-side movement of the mounting post 36, although such restriction may not occur in all embodiments. In the embodiment shown, the mounting post 36 includes a slot-engaging portion 82 that is dimensioned to be received and/or retained in the slot 62 of the rotating arm 48. In some embodiments, the slot-engaging portion 82 is shaped to restrict rotation of the mounting post 36 with respect to the slot 62. For example, this can help prevent twisting of the mounting post 36 when inserting the screw 38. The slot-engaging portion 82 has a generally rectangular cross-section in the example shown, but the slot-engaging portion 82 could have a cross-section of any polygonal shape to restrict rotation of the slot-engaging portion 82 with respect to the slot 62.

In operation, installation of the handleset 10 is more flexible by allowing adjustment of the mounting post 36. The mounting post adjustment assembly 44 allows freedom of movement for the mounting post 36 along two axes. The installer may move the mounting post 36 closer to the grip 12 or further away from the grip 12 (i.e., up-and-down movement) depending on the position of the lower hole 34. Likewise, in certain embodiments, the installer can move the mounting post 36 transversely with respect to the grip 12 (i.e., side-to-side movement) to adjust for the location of the lower hole 34.

Figure 8:
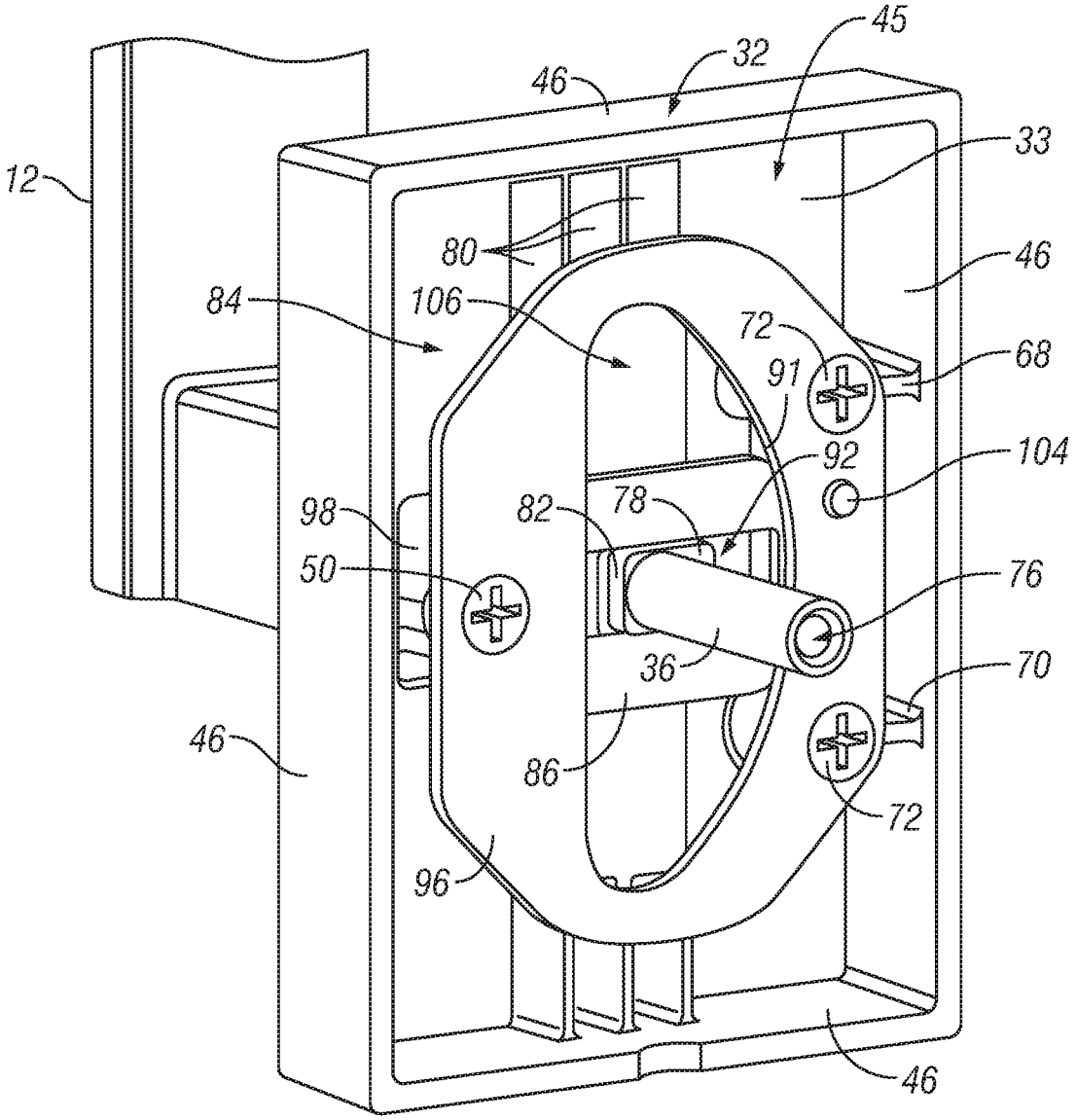
FIG. 8 is a rear perspective view of an example lower mounting plate with an adjustable mounting post according to another embodiment of this disclosure.

FIG. 8 shows the rear portion of the second mounting plate 32 with a mounting post adjustment assembly 84 according to another embodiment. In the embodiment shown, the mounting post adjustment assembly 84 includes a rotating arm 86 pivotally connected to the second mounting plate 32. In the embodiment shown, the rotating arm includes an opening 87 (see FIG. 10) dimensioned to receive and pivot about a fastener 50. As shown, the rotating arm 86 can rotate about the fastener 50 in a first direction 88 or a second direction 90 (FIG. 9), which provides freedom of movement for adjusting the mounting post 36. The rotating arm 86 defines a slot 92 dimensioned to receive the mounting post 36. The mounting post 36 is slidably connected to the rotating arm 86 via the slot 92. In particular, the slot-engaging portion 82 of the mounting post 36 is slidable within the slot 92. This connection allows the mounting post 36 to move within the slot 92 along an axis represented by arrow 94 in FIG. 9, which allows freedom of movement for the mounting post 36. With the pivoting of the rotating arm 86 about the fastener 50, and the slidable movement in the slot 92, the mounting post 36 is adjustable about two axes. This allows the mounting post 36 to be adjusted both horizontally and vertically. Unlike the rotating arm 48, the rotating arm 86 in the mounting post adjustment assembly 84 is planar in shape in the embodiment shown.

Figure 9:
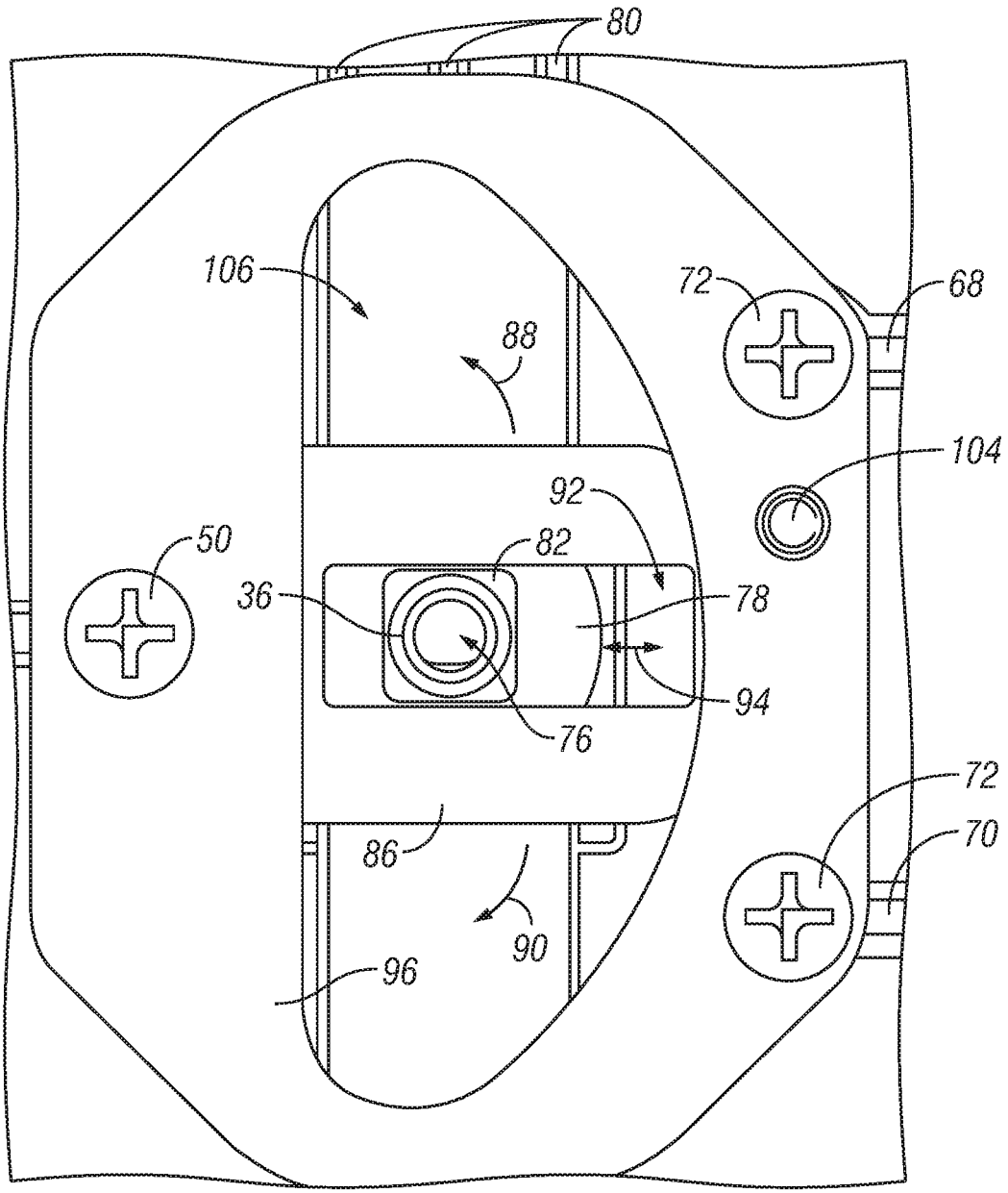
FIG. 9 is a rear view of the lower mounting plate shown in FIG. 8.
Figure 10:
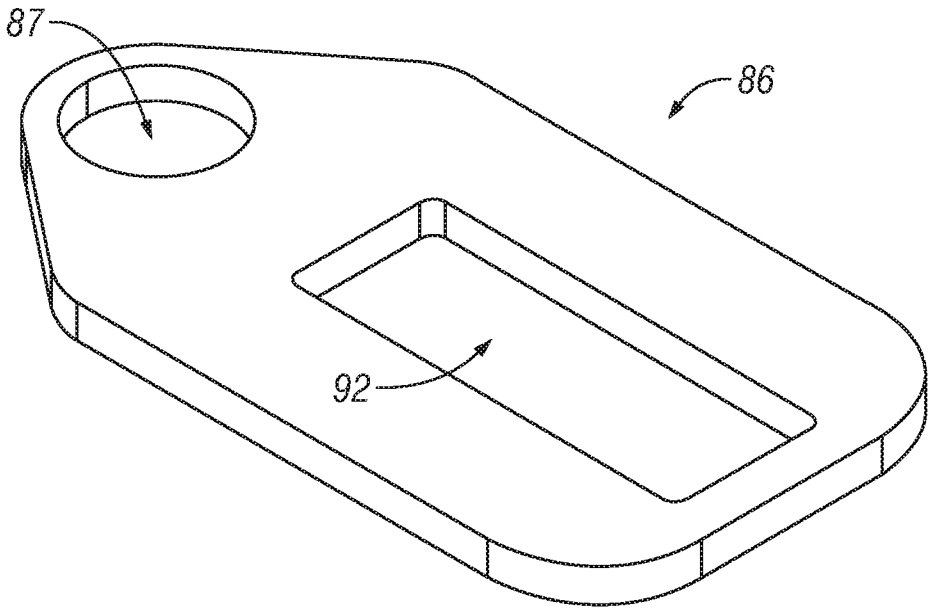
FIG. 10 is a perspective view of the example rotating arm shown in FIGS. 8 and 9.
Figure 11:
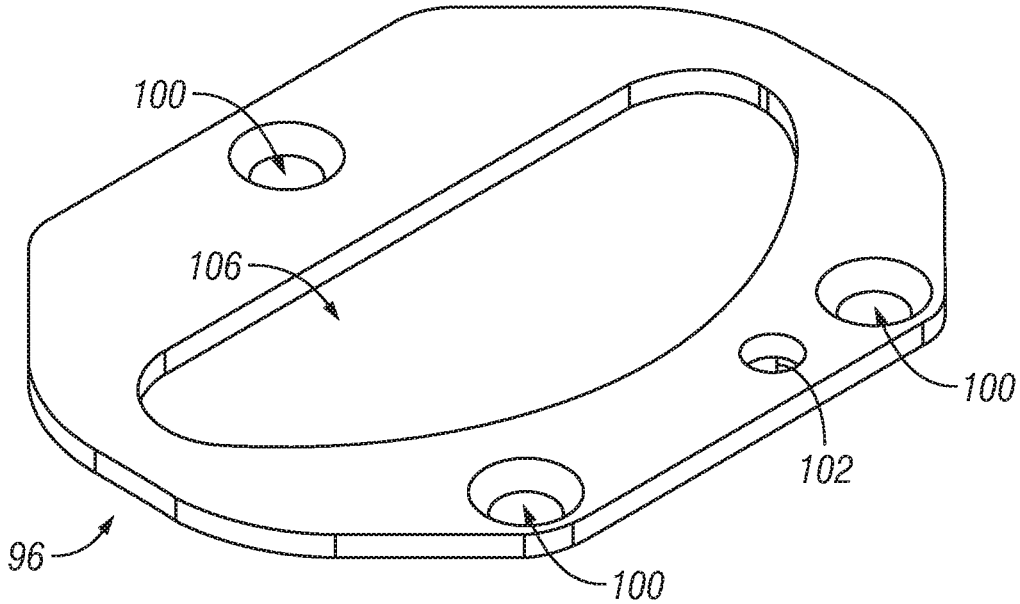
FIG. 11 is a perspective view of the example retaining plate shown in FIGS. 8 and 9.

In the embodiment shown in FIGS. 8 and 9, the mounting post adjustment assembly 84 includes a retaining plate 96 connected to the second mounting plate 32 to increase the strength and rigidity. As shown, the retaining plate 96 defines openings 100 (FIG. 11) for receiving fasteners 50, 72. In this embodiment, the retaining plate 96 is connected to the first rib 68, second rib 70, and a third rib 98 of the second mounting plate 32 using fasteners 72 and fastener 50, respectively. As shown, the retaining plate 96 may also include an opening 102 that is dimensioned to receive a prong 104 extending from the second mounting plate 32. The opening 102 receives the prong 104 as an alignment aid for aligning the openings 100 with the ribs 68, 70, 98 for attaching the retaining plate 96 to the second mounting plate 32. For example, a user could place the prong 104 through the opening 102 to hold the retaining plate 96 in place while the fasteners 50, 72 are installed. As shown, the retaining plate 96 is suspended above the recessed portion 45 and away from the rear side 33 of the second mounting plate 32 to allow the rotating arm 86 to extend under the retaining plate 96 and move within the recessed area 45. In the embodiment shown, the mounting post retaining plate 96 retains the rotating arm 86 to prevent twisting during rotation.

In the embodiment shown, the retaining plate 96 includes a central opening 106. Preferably, the central opening 106 is sized to not obstruct movement with or otherwise interact with the mounting post 36. In the embodiment shown, the slot 92 in the rotating arm 86 is sized to limit movement of the mounting post 36 to prevent interaction between the mounting post 36 and the retaining plate 96. Accordingly, in the embodiment shown, the movement of the mounting post 36 is limited solely by the rotating arm 86 in this embodiment. However, it is envisioned that the movement of the mounting post 36 may be limited by the central opening 106, or may be limited by both the slot 92 in the rotating arm 86 and the central opening 106 of the retaining plate 96. Alternatively still, movement of the mounting post 36 may be at least partially restricted by a guide surface 91 that defines the central opening 106 of the retaining plate 96. The present disclosure is not intended to be limited in the size, shape, or functionality of the retaining plate 96.

EXAMPLES

Illustrative examples of the door handle disclosed herein are provided below. An embodiment of the door handle may include any one or more, and any combination of, the examples described below.

Example 1 is a door handle including a grip having a first end and a second end. The door handle includes a first mounting plate connected to the first end of the grip and a second mounting plate connected to the second end of the grip. The second mounting plate is substantially coplanar with the first mounting plate. The door handle further includes a mounting post coupled to the second mounting plate configured to permit attachment of the second mounting plate to a door. The door handle further includes means for adjusting a position of the mounting post with respect to the second mounting plate, wherein the means facilitates movement of the mounting post along at least two axes.

In Example 2, the subject matter of Example 1 is further configured in which the means for adjusting movement of the mounting post allows movement of the mounting post:

(1) towards the first mounting plate, (2) away from the first mounting plate, and (3) transversely with respect to a longitudinal axis of the grip.

In Example 3, the subject matter of Example 1 is further configured in which the means for adjusting movement of the mounting post allows rotational movement of the mounting post about an axis of rotation.

In Example 4, the subject matter of Example 1 is further configured in which the means for adjusting movement of the mounting post restricts movement of the mounting post along the at least two axes.

In Example 5, the subject matter of Example 1 is further configured in which the mounting post includes an opening configured to receive a fastener.

In Example 6, the subject matter of Example 1 is further configured in which the means for adjusting movement of the mounting post includes a rotating arm pivotally connected to the second mounting plate to rotate about an axis of rotation.

In Example 7, the subject matter of Example 6 is further configured in which the mounting post is connected with the rotating arm.

In Example 8, the subject matter of Example 7 is further configured in which the mounting post rotates about the axis of rotation with rotation of the rotating arm.

In Example 9, the subject matter of Example 7 is further configured in which the mounting post is slidably connected to the rotating arm.

In Example 10, the subject matter of Example 9 is further configured in which the rotating arm defines a slot into which the mounting post extends, and the mounting post includes a slot-engaging portion that is dimensioned to be received within the slot.

In Example 11, the subject matter of Example 10 is further configured in which the slot-engaging portion is shaped to restrict rotation of the mounting post in relation to the slot.

In Example 12, the subject matter of Example 7 is further configured to include a retaining plate mounted to the second mounting plate to increase structural rigidity.

In Example 13, the subject matter of Example 12 is further configured in which at least a portion of the rotating arm extends between the retaining plate and the second mounting plate.

Example 14 is a door handle with a grip having a first end and a second end. The door handle includes a first mounting plate connected to the first end of the grip and a second mounting plate connected to the second end of the grip such that the second mounting plate is substantially coplanar with the first mounting plate and including a recessed area. The door handle includes a mounting post for attaching the second mounting plate to a door. A rotating arm is provided that is pivotally connected to the second mounting plate and pivotable in the recessed area. The mounting post is slidably connected to the rotating arm.

In Example 15, the subject matter of Example 14 is further configured in which the rotating arm defines a slot into which the mounting post extends.

In Example 16, the subject matter of Example 15 is further configured in which the mounting post includes a slot-engaging portion that is dimensioned to be received within the slot of the rotating arm.

In Example 17, the subject matter of Example 16 is further configured in which the slot-engaging portion is shaped to restrict rotation of the mounting post in relation to the slot of the rotating arm.

In Example 18, the subject matter of Example 15 is further configured with a retaining plate mounted to the second mounting plate to increase structural rigidity.

In Example 19, the subject matter of Example 14 is further configured to include a retaining plate mounted to the second mounting plate, the retaining plate formed to include a groove or opening that the mounting post at least partially extends through.

Example 20 is a method of installing a door handle. The method comprising the steps of: providing a door handle with a grip having a first end and a second end, a first mounting plate connected to the first end of the grip, a second mounting plate connected to the second end of the grip, and a mounting post connected to the second mounting plate for attaching the second mounting plate to a door; aligning the mounting post with a hole in a door by adjusting a position of the mounting post with respect to the second mounting plate along at least two axes; and connecting the door handle to the door.

We claim:

1. A door handle comprising:

a grip having a first end and a second end;

a first mounting plate connected to the first end of the grip;

a second mounting plate connected to the second end of the grip, the second mounting plate being substantially coplanar with the first mounting plate;

a mounting post coupled to the second mounting plate configured to permit attachment of the second mounting plate to a door; and means for adjusting a position of the mounting post along at least two axes relative to the second mounting plate, wherein the means for adjusting movement of the mounting post allows movement of the mounting post to permit alignment with a hole in the door during installation of the door handle.

2. The door handle of claim 1, wherein the means for adjusting movement of the mounting post allows movement of the mounting post: (1) towards the first mounting plate, (2) away from the first mourning plate, and (3) transversely with respect to a longitudinal axis of the grip.

3. The door handle of claim 1, wherein the means for adjusting movement of the mounting post allows rotational movement of the mounting post about an axis of rotation.

4. The door handle of claim 1, wherein the means for adjusting movement of the mounting post restricts movement of the mounting post along the at least two axes.

5. The door handle of claim 1, wherein the mounting post includes an opening configured to receive a fastener.

6. The door handle of claim 1, wherein the means for adjusting movement of the mounting post includes a rotating arm pivotally connected to the second mounting plate to rotate about an axis of rotation.

7. The door handle of claim 6, wherein the mounting post is connected with the rotating arm.

8. The door handle of claim 7, wherein the mounting post rotates about the axis of rotation with rotation of the rotating arm.

9. The door handle of claim 7, wherein the mounting post is slidably connected to the rotating arm.

10. The door handle of claim 9, wherein the rotating arm defines a slot into which the mounting post extends, and the mounting post includes a slot-engaging portion that is dimensioned to be received within the slot.

11. The door handle of claim 10, wherein the slot-engaging portion is shaped to restrict axial rotation of the mounting post in relation to the slot.

12. The door handle of claim 7, further comprising a retaining plate mounted to the second mounting plate to increase structural rigidity.

13. The door handle of claim 12, wherein at least a portion of the rotating arm extends between the retaining plate and the second mounting plate.

14. A door handle comprising:

a grip having a first end and a second end;

a first mounting plate connected to the first end of the grip;

a second mounting plate connected to the second end of the grip, the second mounting plate being substantially coplanar with the first mounting plate, the second mounting plate including a recessed area defined by a side wall and a rear side of the second mounting plate;

a mounting post for attaching the second mounting plate to a door; a rotating arm pivotally connected to the second mounting plate and pivotable in the recessed area; and wherein the mounting post is slidably connected to the rotating arm so that the mounting post is slidably movable relative to the rotating arm to allow movement of the mounting post to permit alignment with a hole in the door during installation of the door handle.

15. The door handle of claim 14, wherein the rotating arm defines a slot into which the mounting post extends.

16. The door handle of claim 15, wherein the mounting post includes a slot-engaging portion that is dimensioned to be received within the slot of the rotating arm.

17. The door handle of claim 16, wherein the slot-engaging portion is shaped to restrict axial rotation of the mounting post in relation to the slot of the rotating arm.

18. The door handle of claim 14, further comprising a retaining plate mounted to the second mounting plate, the retaining plate formed to include a groove or opening that the mounting post at least partially extends through.

19. The door handle of claim 18, wherein a portion of the retaining plate is capable of at least partially restricting movement of the mounting post.

* * * * *